US006798324B2

(12) United States Patent
Richter

(10) Patent No.: US 6,798,324 B2
(45) Date of Patent: Sep. 28, 2004

(54) CIRCUIT BREAKER SWITCHING MECHANISM

(75) Inventor: David N. Richter, Mexico, MO (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/268,847

(22) Filed: Oct. 10, 2002

(65) Prior Publication Data

US 2004/0069603 A1 Apr. 15, 2004

(51) Int. Cl.[7] ..... H01H 75/12
(52) U.S. Cl. ..... 335/172; 335/35
(58) Field of Search ..... 335/23–25, 35–42, 335/165–176, 202; 200/400–401

(56) References Cited

U.S. PATENT DOCUMENTS 4,679,016 A * 7/1987 Ciarcia et al. ..... 335/132
4,737,606 A 4/1988 Winter
5,008,504 A 4/1991 Ozaki et al.
5,082,996 A 1/1992 Takahashi et al.
5,500,496 A 3/1996 Venzke et al.
5,539,167 A 7/1996 Hood et al.
5,692,599 A 12/1997 Winter

* cited by examiner

*Primary Examiner*—Lincoln Donovan
(74) *Attorney, Agent, or Firm*—Kareem M. Irfan

(57) ABSTRACT

A switching mechanism for use in an electromechanical device, such as a circuit breaker, comprising a stationary contact, a blade assembly having a blade, which includes a movable contact, a frame guide having a guiding area, a trip lever, a tripping mechanism, a lower link, and an upper link. The trip lever is connected to the frame guide and causes the separation of the movable contact from the stationary contact, thus switching the device from an ON position to a TRIPPED position. The tripping mechanism is adapted for holding the trip lever in the ON position, and for releasing it to the TRIPPED position when a tripping condition occurs. The lower link is adapted for moving the blade between the ON and the TRIPPED positions. The upper link includes an interface area which is adapted to remain in continuous contact with the guiding area for accelerating the tripping action.

21 Claims, 9 Drawing Sheets

CIRCUIT BREAKER SWITCHING MECHANISM

FIELD OF THE INVENTION

This invention is directed generally to electromechanical devices and, more specifically, to a switching mechanism used in a circuit breaker.

BACKGROUND OF THE INVENTION

Electrical devices, such as circuit breakers, are used in many residential, commercial, and industrial electric systems, being indispensable components of such systems in protecting against over-current conditions. In response to application-specific needs, such as response time, space constraints, efficiency, capacity, and type of reset function (manual or remote), a variety of different switching mechanisms for circuit breakers have been developed.

Some switching mechanisms focus on reducing the period of time that is required to switch the circuit breaker from an ON position to a TRIPPED position. In the ON position the circuit breaker allows current flow through a particular electrical circuit, while in the TRIPPED position the circuit breaker prevents the current flow. A faster switching mechanism allows a circuit breaker or other electrical device to perform at higher current levels, e.g., the circuit breaker can achieve a higher current-interrupt level.

For example, a prior art circuit breaker has a switching mechanism that includes a toggle link unit, which is connected to a trip lever and a carrier. The toggle link unit has two components connected by a center pin, an upper link and a lower link. The upper link is connected to the trip lever, wherein the trip lever, which is swingably supported at one end, is normally engaged with a tripping mechanism to prevent the trip lever from swinging. The lower link is connected to the carrier, wherein the carrier is rotatably supported by a switching shaft and has a movable blade. The moveable blade has a movable contact that, in the ON position, is in contact with a stationary contact. When a tripping condition occurs, e.g., the current level in an electrical device protected by the circuit breaker is higher than the accepted level for the circuit breaker, the trip lever is disengaged from the tripping mechanism and the switching mechanism is actuated. Specifically, the trip lever rotates in a counterclockwise motion causing a chain reaction that results in the movable contact being separated from the stationary contact. The motion of the upper link is directed in part by a separate piece, an interfering stopper, which attempts to move the upper link in a straight, rather than curved, path However, a switching mechanism similar to the one described above has a number of drawbacks related to the size and the interrupt levels that the circuit breaker may achieve. For example, using the separate stopper has at least two drawbacks: it necessarily increases the size of the circuit breaker, and it adds an additional step during assembly. Less parts and less assembly steps generally result in a more compact, less expensive circuit breaker.

Another drawback is that the speed of the switching mechanism is slow, therefore limiting the current-interrupt levels that the circuit breaker could potentially achieve. Although the mechanism design attempts to minimize the rather large swing radius of the upper link, it nevertheless fails to continuously drive the upper link. The stopper does not provide continuous contact with the upper link that would result in a continuous driving force. A continuous driving force would result in a faster moving switching mechanism because it would keep the upper link moving at all times, and because it would direct the upper link to follow a more direct path than the path the upper link would normally follow.

Accordingly, there is a need for an improved switching mechanism which overcomes the above-mentioned and other drawbacks

SUMMARY OF THE INVENTION

Briefly, in accordance with the foregoing, the invention relates to a switching mechanism for use in an electromechanical device, such as a circuit breaker. The switching mechanism comprises a stationary contact, a blade assembly having a blade, which includes a movable contact, a frame guide having a guiding area, a trip lever, a tripping mechanism, a lower link, and an upper link. The trip lever is connected to the frame guide to cause the separation of the movable contact from the stationary contact, wherein the movable contact is in contact with the stationary contact in an ON position of the circuit breaker and is separated from the stationary contact in a TRIPPED position of the circuit breaker. The tripping mechanism is adapted for holding the trip lever in the ON position, wherein the tripping mechanism releases the trip lever to the TRIPPED position when a tripping condition occurs. The lower link has a first end and a second end, and is adapted for moving the blade between the ON and the TRIPPED positions. The first end is connected to the blade assembly. The upper link includes a lower link end, a trip lever end, and an interface area, wherein the lower link end is connected to the second end of the lower link, the trip lever end is connected to the trip lever, and the interface area is adapted to remain in continuous contact with the guiding area in the ON position, in the TRIPPED position, and while moving between the ON position and the TRIPPED position.

In one embodiment of the invention, the switching mechanism comprises an upper link that includes a first end adapted for connecting to a trip lever; a second end adapted for connecting to a lower link; a first slidably-engaging surface adapted for driving an initial motion of the upper link when a TRIPPING condition occurs; a second slidably-engaging surface adapted to continue driving the upper link after the first slidably-engaging surface has partially driven the upper link and until the switching mechanism is in a TRIPPED position; a clearance surface located between the first slidably-engaging surface and the second slidably-engaging surface; and a front surface located near the first end adapted for holding the upper link stopped in the TRIPPED position.

In another embodiment of the invention, the switching mechanism comprises a frame that includes a support structure and a guide structure. The guide structure is integrated to form a single component with the support structure, comprising an angled surface adapted for holding the switching mechanism in an ON position and for driving an initial motion of an upper link when a TRIPPING condition occurs; a ramp surface adapted to continue driving the upper link after the angled portion has partially driven the upper link and until the switching mechanism is in a TRIPPED position; and a resting surface adapted for holding the upper link stopped in the TRIPPED position.

DETAILED DESCRIPTION OF THE ILLUSTRATED EMBODIMENT

Figure 1:
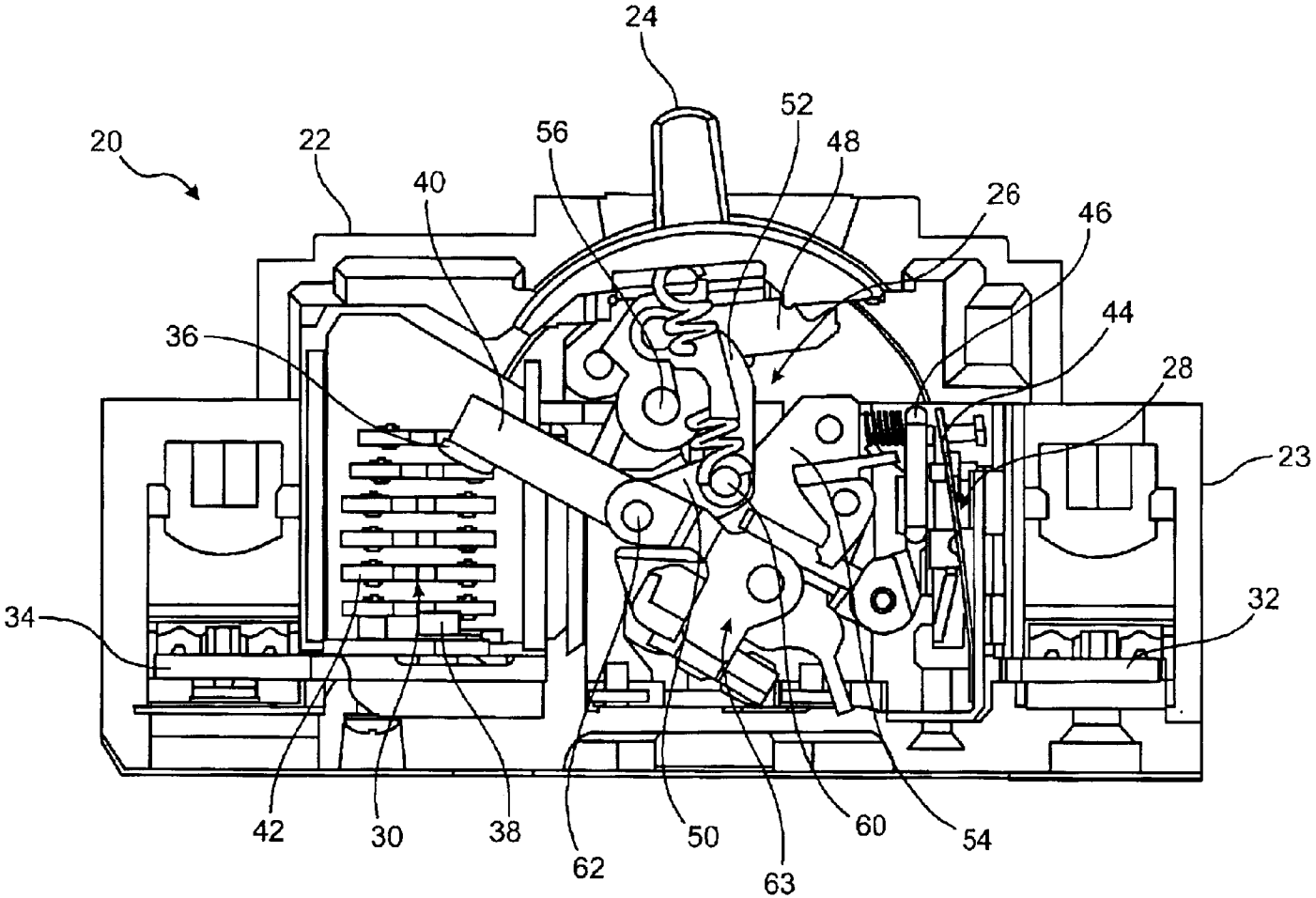
FIG. 1 is a cross-sectional diagrammatic of a circuit breaker embodying the present invention, shown in a TRIPPED position.

Referring now to the drawings, and initially to FIG. 1, an electro-mechanical device such as a circuit breaker 20 will be described in general. The circuit breaker 20 contains, generally, a cover 22, a base 23, a handle 24, a switching mechanism 26, a tripping mechanism 28, and an arc-extinguishing assembly 30.

In general, most components of the circuit breaker 20 are installed on the base 23 and secured therein after the cover 22 is attached to the base 23. The handle 24 protrudes through the cover 22 for manual resetting of the circuit breaker 20. The handle 24 is also adapted to serve as a visual indication of the position of the circuit breaker 20, wherein the circuit breaker 20 has several positions. One position of the circuit breaker 20 is an ON position. When the circuit breaker 20 is in the ON position current flows unrestricted through the circuit breaker 20 and, therefore, through the electrical device or circuit that the circuit breaker is designed to protect. Another position of the circuit breaker 20 is a TRIPPED position, which is shown in FIG. 1. The TRIPPED position interrupts the flow of current through the circuit breaker 20 and, consequently, through the electrical device or circuit that the circuit breaker is designed to protect The TRIPPED position is caused by the presence of a higher current than the assigned current for the circuit breaker 20 over a specified period of time. The exposure of the circuit breaker 20 to a longer period of high current than otherwise permissible activates the tripping mechanism 28 which causes the switching mechanism 26 to interrupt the current flow.

Current enters the circuit breaker 20 through a first contact 32 and exits the circuit breaker 20 through a second contact 34. The current also passes through a pair of contacts, a movable contact 36 and a stationary contact 38. The movable contact 36 is attached to a blade carrier assembly 40, which is connected to the switching mechanism 26. In the ON position (not shown) the movable contact 36 is in contact with the stationary contact 38, while in the TRIPPED position (shown) the movable contact 36 is separated from the stationary contact 38.

The tripping mechanism 28 is the component that drives the tripping action using, in general, a spring-biased trip lever mechanism to force the blade carrier assembly 40, and therefore the movable contact 36, away from the stationary contact 38. When the current reaches a predetermined value, which is generally based on a percentage of the rated current for a period of time, the tripping mechanism 28 is activated. The tripping mechanism 28 passes the current through and thereby heats a bimetal 44, causing the bimetal 44 to bend. As a result, the bimetal 44, now bent, contacts and activates a trip cross bar 46 which causes the switching mechanism 26 to rotate the blade carrier assembly 40 away from the stationary contact 38. The end result is that the circuit breaker 20 is in the TRIPPED position, opening the particular circuit.

When the tripping mechanism 28 trips the circuit breaker 20 the blade carrier assembly 40 swings up through the arc-extinguishing assembly 30, which has the purpose of receiving and dissipating electrical arcs that are created when the movable contact 36 separates from the stationary contact 38. The arc-extinguishing assembly 30 includes an arc stack having a number of arc plates 42 which are offset at equal distances from one another, being supported on each side by an insulating plate. The plates 42 are generally rectangular in shape, identical to one another, and interconnected. Each plate 42 has an arc throat that creates a path for the blade carrier assembly 40 to open when the circuit breaker 20 is tripped, or to close when the circuit breaker 20 is reset. The path is formed by laterally offsetting the identical arc plates 42 relative to one another in the same direction, tracing the imaginary radius that the blade carrier assembly 40 creates when opening or when closing.

Figure 7:
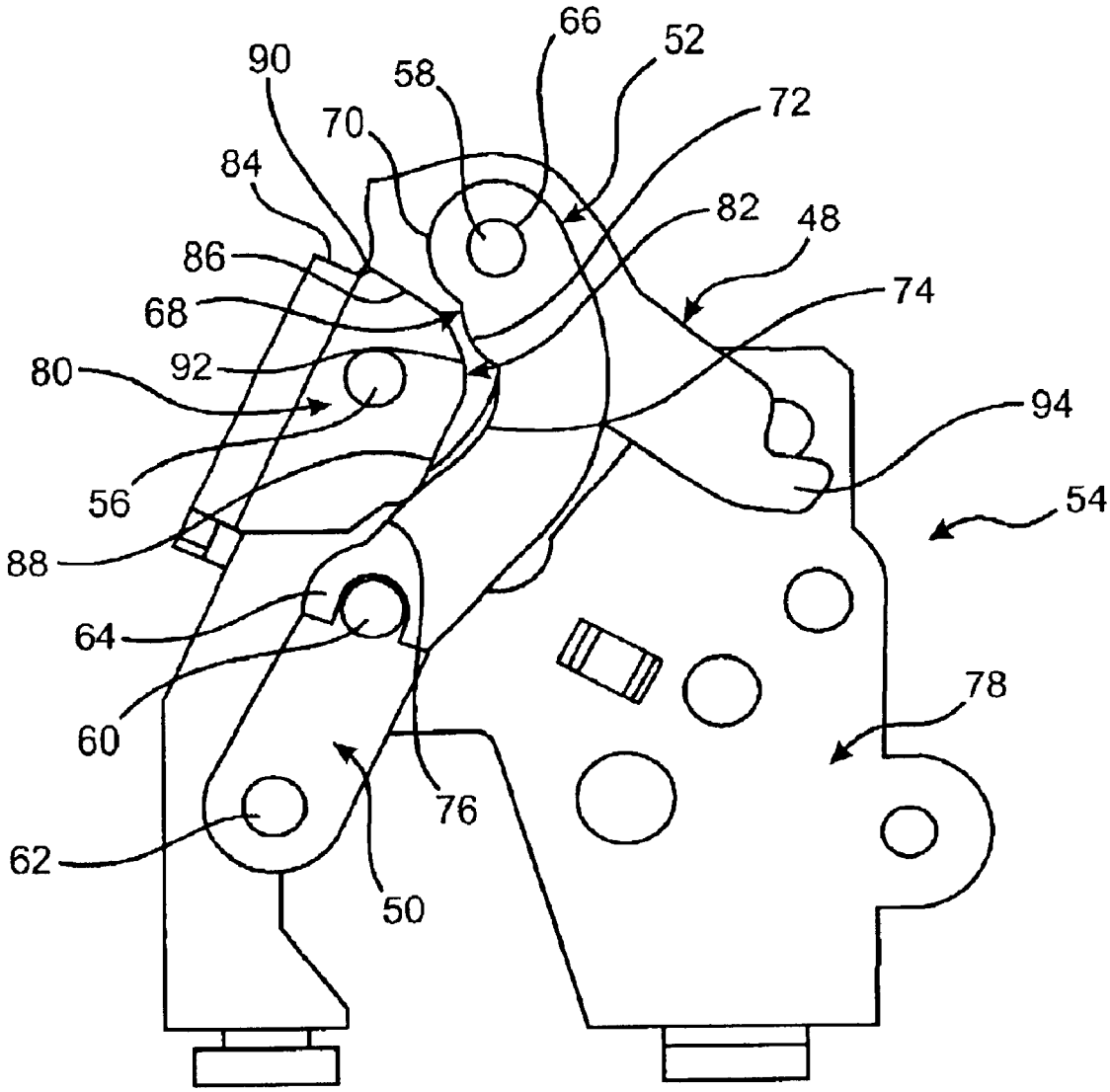
FIG. 7 is a diagrammatic showing the position of the upper link of FIG. 2 and frame structure of FIG. 4 in an ON position.

The switching mechanism 26 contains several components, including a trip lever 48, a lower link 50, an upper link 52, and a frame structure 54. For ease of understanding, please note that the description will refer to a single lower link 50, to a single upper link 52, and to a single frame structure 54, even though in reality there are two symmetrically-located components of each. The trip lever 48 is pivotally connected by a trip lever pivot pin 56 to the frame structure 54, and by an upper link pivot pin 58 (shown in FIG. 7) to the upper link 52. The upper link 52 is connected by a joint pin 60 to the lower link 50, which is in turn connected by a blade carrier pin 62 to the blade carrier assembly 40.

Figure 2:
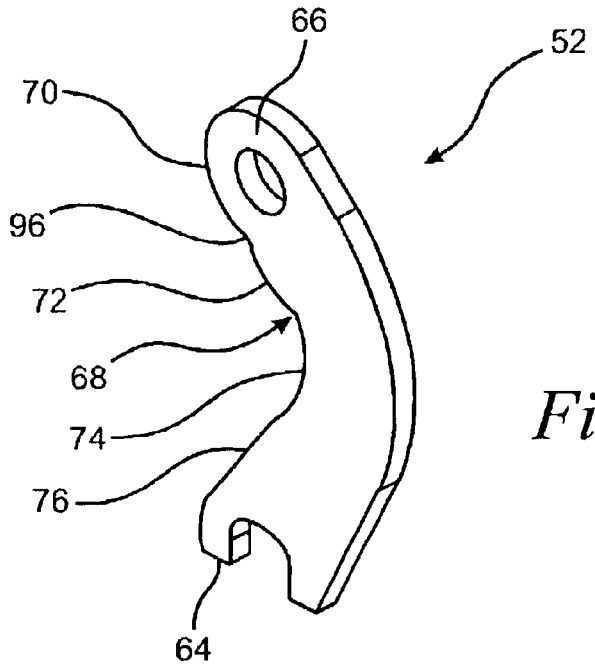
FIG. 2 is a perspective view of an upper link.
Figure 3:
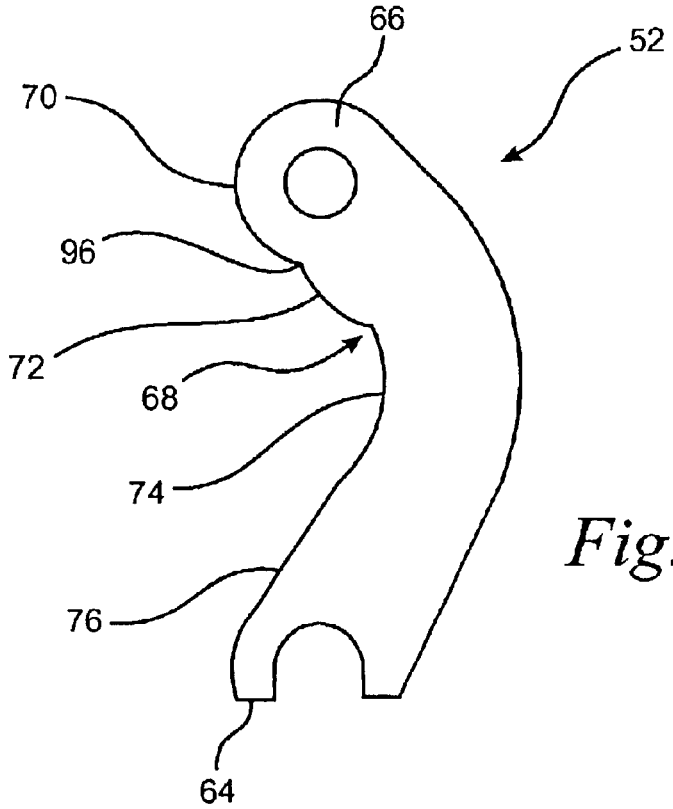
FIG. 3 is an elevation view of the upper link shown in FIG. 2.

Referring now to FIGS. 2 and 3, an embodiment of the upper link 52 will be described in more detail. The upper link 52 includes a lower link end 64, a trip lever end 66, and an interface area 68. The lower link end 64 is connected to the lower link 50 by the joint pin 60, and the trip lever end 66 is connected to the trip lever 48 by the trip lever pivot pin 56. The interface area 68 has several surfaces, including a radiused front surface 70, a slidably-engaging protrusion surface 72, a clearance surface 74, and a link angled surface 76. The radiused front 70 is also referred to as a front area or radiused bulge, it is located near the trip lever end 66, and it has a generally curved shaped. The protrusion 72 is a radially-shaped bulge that is located next to the radiused front 70. The clearance surface 74 is located next to the protrusion 72, towards the middle section of the upper link 52, and it has a generally curved shaped going in the opposite direction compared to the protrusion 72. Thus, the upper link 52 is wider in the general section of the protrusion 72 but is thinner in the general section of the clearance surface 74. The link angled surface 76 is located next to the clearance surface 74, near the lower link end 64, and it is has a slidably-engaging, relatively flat angle shape. In other embodiments other shapes can be used for the protrusion 72 and for the radiused front surface 70. However, a radiused surface is easier to manufacture and it gives a single point of contact between two slidably-engaging surfaces, such as the sliding motion between the radiused protrusion 72 and the ramp surface 86 A single point of contact reduces friction and erratic opening of the blade carrier assembly 40 that might occur if there were multiple contact points. In one embodiment of the invention, the upper link 52 is made of stainless steel. In other embodiments, different alloy steels or any other suitable materials can be used.

Figure 4:
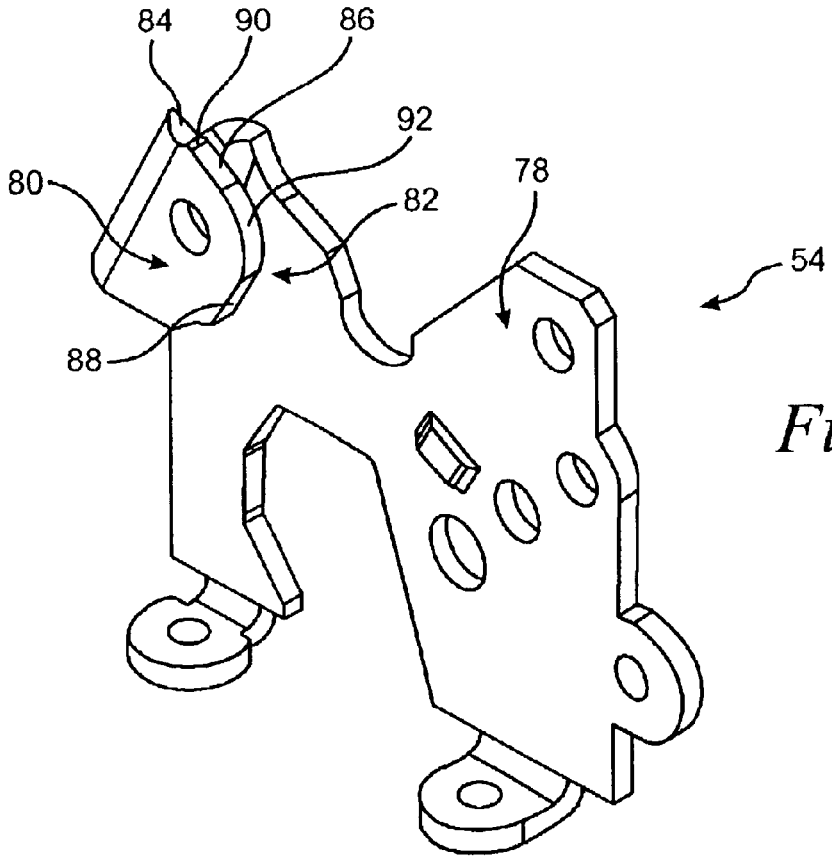
FIG. 4 is a perspective view of a frame structure.
Figure 5:
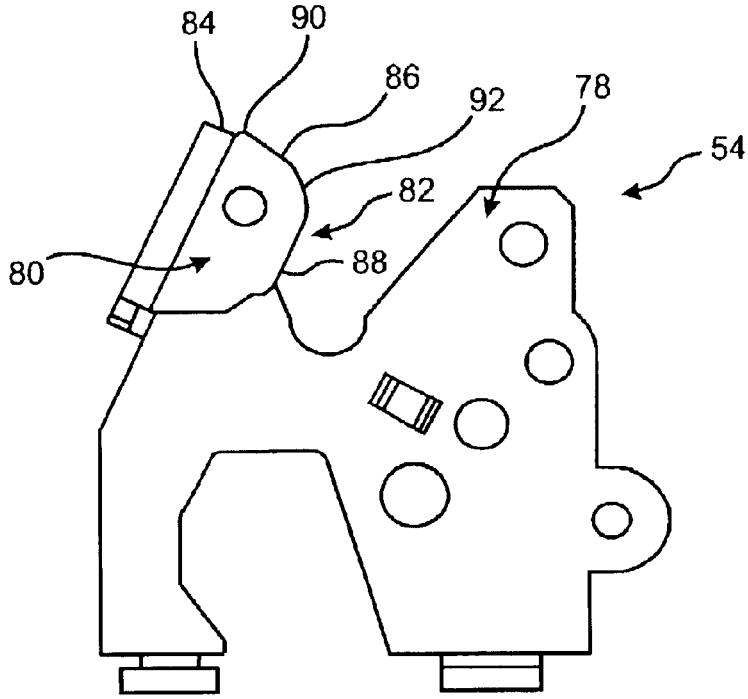
FIG. 5 is an elevation view of the frame structure shown in FIG. 4.

Referring now to FIGS. 4 and 5, an embodiment of the frame structure 54 will be described in more detail. The frame structure 54 includes a support structure 78 and an integrated guide structure 80. The support structure 78, in general, holds the switching mechanism 26 fixed in the cover 22. The guide structure 80, also referred to as a frame guide, forms a single piece with the support structure 78 and it is located near an upper end of the support structure 78. The guide structure 80 has a guiding area 82, which includes a resting surface 84, a ramp surface 86, and a guide angled surface 88. The resting surface 84 is located near one end of the guiding area 82 and it includes a sharp notch 90. The ramp surface 86 is a relatively flat surface located ending in the notch 90 and it is slightly angled upward, away from the support structure 78. The guide angled surface 88 is located closer to the support structure 78, as compared to the resting surface 84 and the ramp surface 86, and it is oriented generally perpendicular to the direction of the ramp surface 86. A fillet 92 connects the guide angled surface 88 to the ramp surface 86. In one embodiment of the invention, the frame structure 54 is made of stainless steel. In other embodiments, different alloy steels or any other suitable materials can be used.

Figure 6:
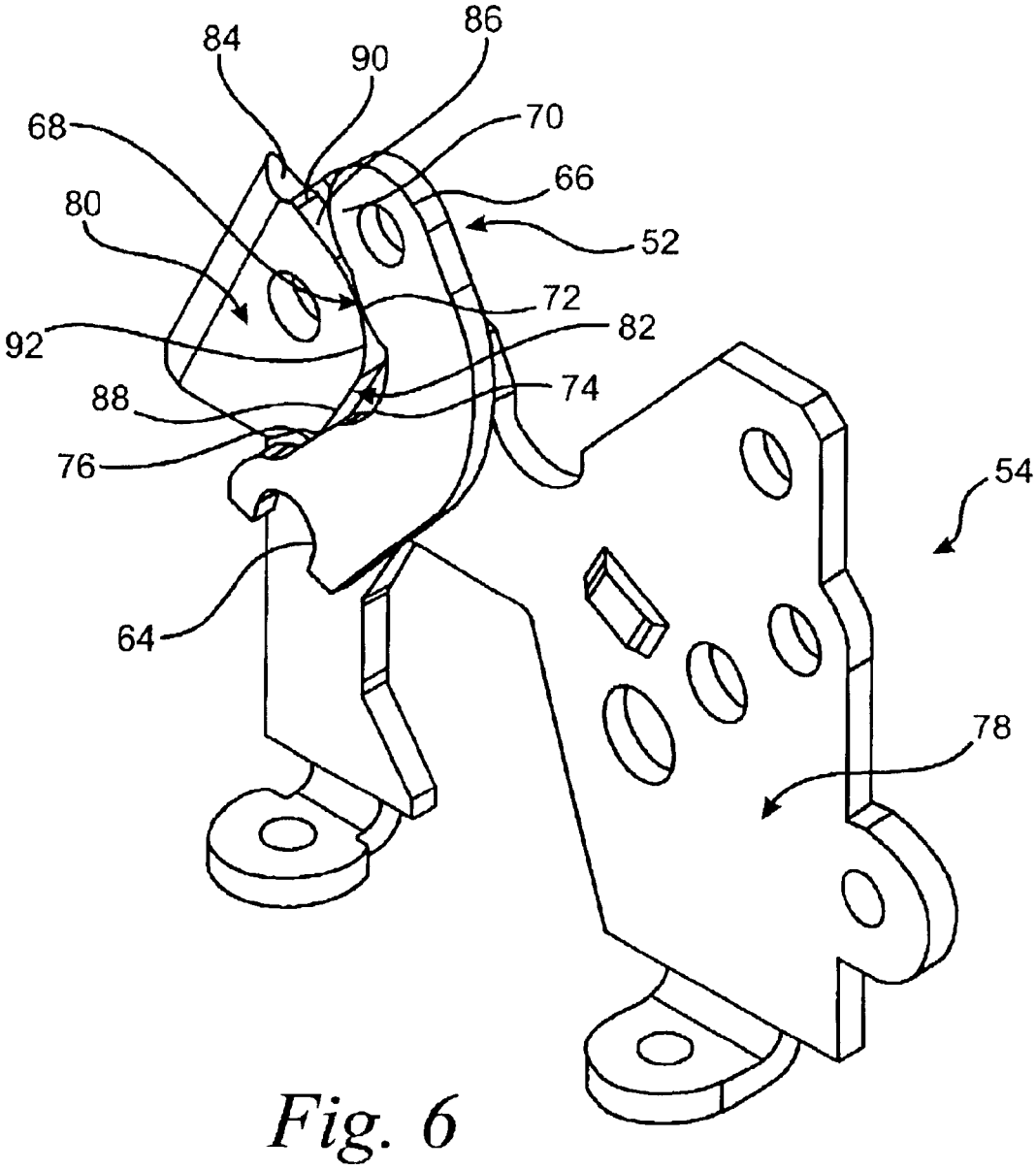
FIG. 6 is a perspective view showing the position of the upper link of FIG. 2 relative to the frame structure of FIG. 4.

Referring now to FIG. 6, the location of the upper link 52 will be described relative to the frame structure 54 when the circuit breaker 20 is in the ON position. The interface area 68 is located proximate the guiding area 82, wherein the two areas slidably-engage each other during the ON position, during the TRIPPED position, and during the transition period between the ON and the TRIPPED positions. The lower link end 64 is located near the guide angled surface 88, and the trip lever end 66 is located near the ramp surface 86. The link angled surface 76 is in partial contact with the guide angled surface 88, wherein the guide angled surface 88 provides a positive stop for the switching mechanism 26. The positive stop means that the blade carrier assembly 40 is kept firmly in place to allow current flow across the movable contact 36 and the stationary contact 38.

Referring now to FIGS. 7–10, the interaction between the upper link 52 and the guide structure 80 will be described in more detail. In the ON position, depicted in FIG. 7, the only contact between the upper link 52 and the guide structure 80 occurs between the link angled surface 76 which rests on the guide angled surface 88. At this point the blade carrier assembly 40 (shown in FIG. 1) is held steady so that the movable contact 36 is in contact with the stationary contact 38. The lower link 50 is oriented in a slightly off-vertical position, and the trip lever 48 has a tripping end 94 held against a locking mechanism (not shown).

Figure 8:
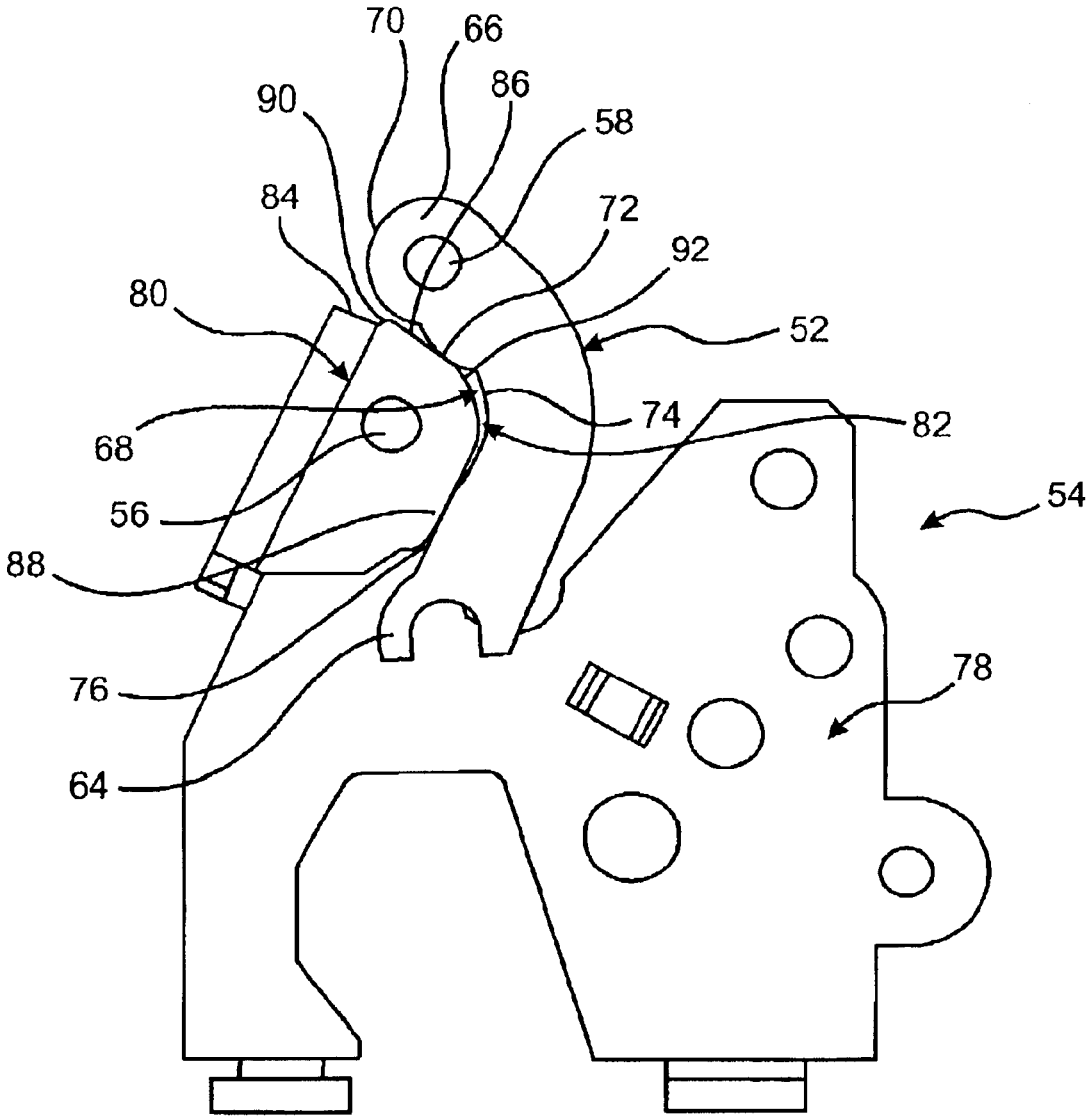
FIG. 8 is a diagrammatic showing the position of the upper link of FIG. 2 and frame structure of FIG. 4 in a first intermediate position.

In a first intermediate position, depicted in FIG. 8, the tripping end 94 (shown in FIG. 7) has been released causing the trip lever 48 to swing up in a counterclockwise motion rotating about the trip lever pivot pin 56. This causes the rotation of the upper link 52 which initially rotates counterclockwise generally about the trip lever pivot pin 56. As the upper link 52 rotates it pulls the lower link 62 (shown in FIG. 7) which in turn causes the counterclockwise rotation of the blade carrier assembly 40, beginning to separate the movable contact 36 from the stationary contact 38. The sliding motion of the link angled surface 76 along the guide angled surface 88 helps drive the upper link 52 upwards to cause the separation of the movable contact 36 from the stationary contact 38. For example, if the upper link 52 would not be driven along a guiding area such as the guide angled surface 88 the lower link end 64 would try initially to move in a direction that is generally toward the guide structure 80. This means that the joint pin 60 would not move upwards but inwards, toward the guide structure 80. Thus, the blade carrier pin 62 would initially cause very little, if any, separation of the movable contact 36 from the stationary contact 38. The presence of the two interfacing surfaces, the link angled surface 76 and the guide angled surface 88 ensures that any movement of the upper link 52 translates into the separation of the movable contact 36 from the stationary contact 38.

Additionally, the radiused protrusion 72 now slidably-engages the ramp surface 86. The simultaneous contact of the radiused protrusion 72 to the ramp surface 86 and of the link angled surface 76 to the guide angled surface 88 helps in keeping the upper link 52 continuously driven, which in turn ensures continuous and fast separation of the movable contact 36 from the stationary contact 38. The radiused protrusion 72, as described below, eventually takes over in driving the continuous motion of the upper link 52 by itself, as the link angled surface 76 will separate from the guide angled surface 88. Nevertheless, at least one surface of the interface area 68 is always in contact with at least one surface of the guiding area 82 to ensure the continuous separation of the movable contact 36 from the stationary contact 38.

Figure 9:
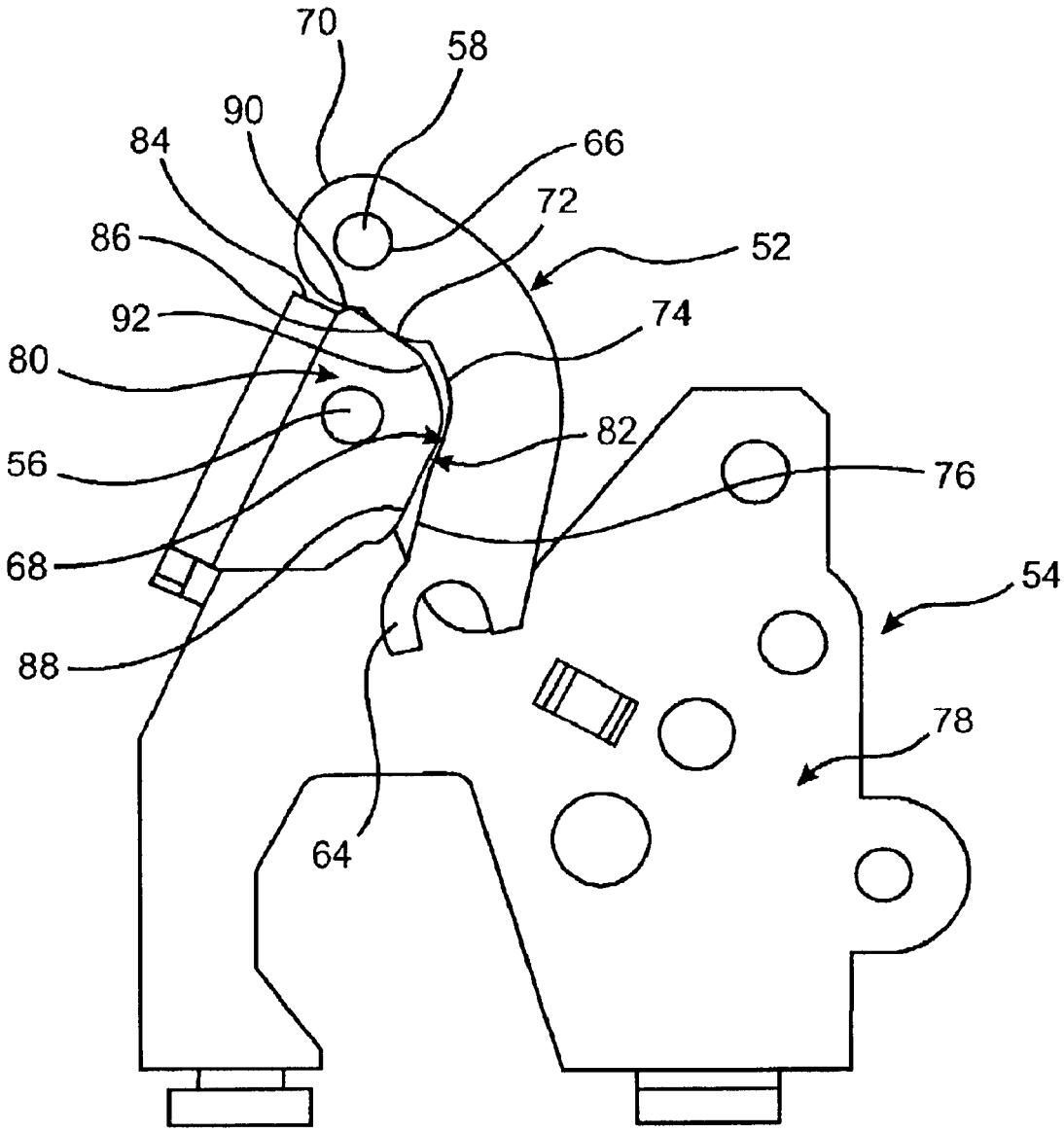
FIG. 9 is a diagrammatic showing the position of the upper link of FIG. 2 and frame structure of FIG. 4 in a second intermediate position.

In a second intermediate position, depicted in FIG. 9, the switching mechanism 26 is closer to reaching the TRIPPED position. The link angled surface 76 is separated from the guide angled surface 88 and the driving of the upper link 52 is done now entirely through the contact between the radiused protrusion 72 and the ramp surface 86. Furthermore, throughout the motion of the upper link 52 from the ON position to the TRIPPED position, the clearance surface 74 is adapted to keep the surface contact between the interface area 68 and the guiding area 82 minimal for achieving a faster, steady, and consistent movement of the upper link 52. For example, if the interface area 68 would be a uniform curved shape that would slide along a complementary uniformly-shaped guiding area 82, having a multitude of contact points, the motion of the upper link 52 would be slower because of friction forces caused by the sliding of the surfaces of the two areas, because of manufacturing irregularities located on each surface of the two areas, and, possibly, because of debris caught in-between the surfaces of the two areas. Thus, the clearance surface 74 helps in making the motion of the upper link 52 fast and consistent.

After the radiused protrusion 72 makes initial contact with the ramp surface 86 and before the movable contact 36 is completely separated from the stationary contact 38, i.e., the circuit breaker 20 is in the TRIPPED position, the rotation pivoting point of the upper link 52 shifts from the trip lever pivot pin 56 to the upper link pivot pin 58. As the radiused protrusion 72 moves towards the notch 90, the shift in the pivoting point increases the speed of the upper link 52 by accelerating the lower link end 64. This results in an accelerated separation of the movable contact 36 from the stationary contact 38 towards the end of the upper link 52 travel. A more detailed description of this accelerating sequence will be described below in reference to FIG. 11.

Figure 10:
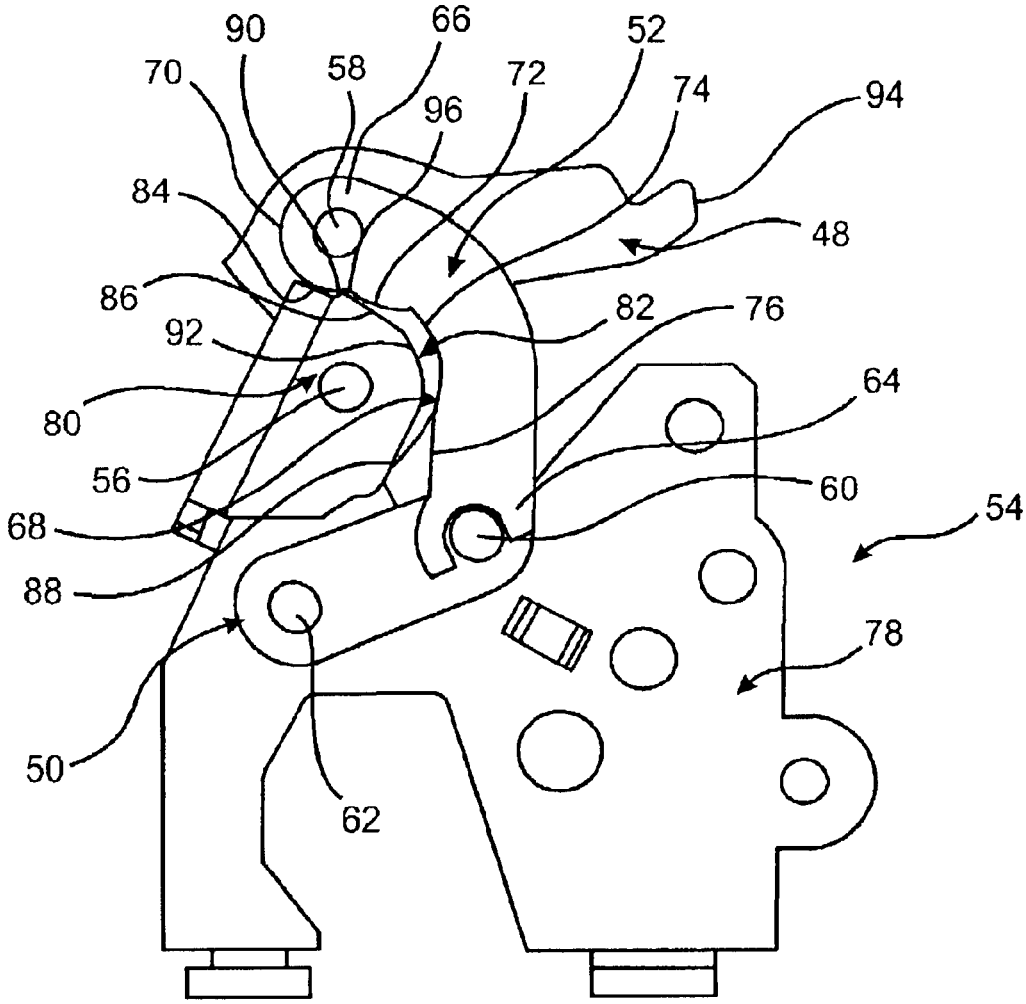
FIG. 10 is a diagrammatic showing the position of the upper link of FIG. 2 and frame structure of FIG. 4 in a TRIPPED position.

In the TRIPPED position, depicted in FIG. 10, the main contact occurs between the radiused front 70 and the resting surface 84, although some contact still remains between the radiused protrusion 72 and the ramp surface 86. The trip lever 48 has reached the end of its travel as shown by the tripping end 94 which is now shown up and away from the frame structure 54, in a generally horizontal orientation. In turn, the movable contact 36 is now at the end of its separation distance from the stationary contact 38. The notch 90 provides a locking feature for the upper link 52 by penetrating into a recession 96 that is formed between the radiused front 70 and the radiused protrusion 72. Thus, the resting surface 84 couples with the radiused front 70 to stop the rotation of the upper link 52. Further, the notch 90, which can be considered part of the resting surface 84, couples with the recession 90, which can be considered part of the radiused front 70, to prevent the motion of the upper link 52, and, consequently, of the switching mechanism 26.

Figure 11:
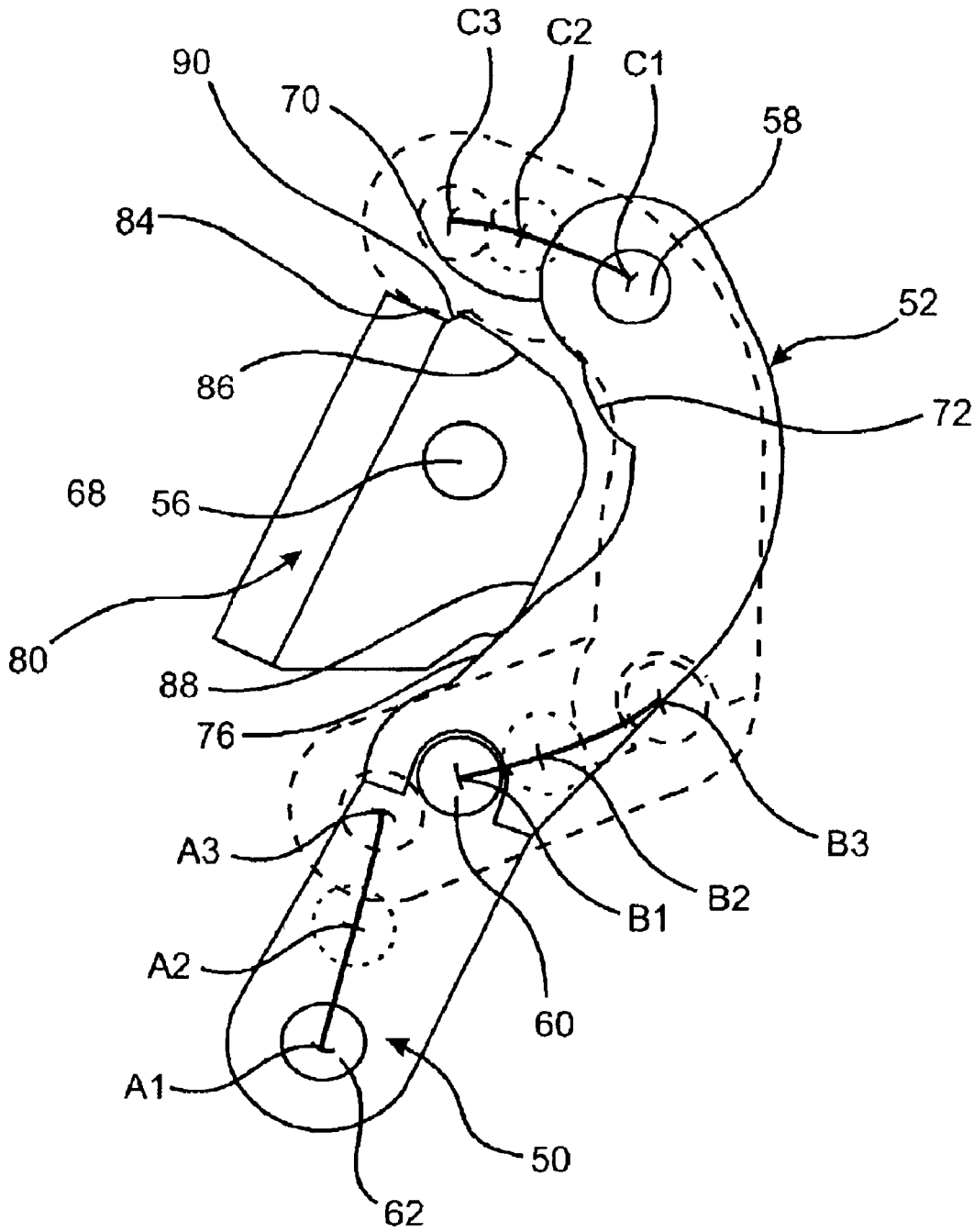
FIG. 11 is a diagrammatic showing the overlapping positions of the upper link of FIG. 2 relative to a portion of the frame structure of FIG. 4 for the ON position, an intermediate position, and the TRIPPED position.

Referring now to FIG. 11, the effect of the shift in pivoting of the upper link 52 from the trip lever pivot pin 56 to the upper link pivot pin 58 will be described more clearly. The position of the upper link 52 and the lower link 50 in the ON position is shown in solid lines, and the position of the upper link 52 and the lower link 50 in the TRIPPED position is shown in long-dashed lines. The circles in short-dashed lines indicate the position of the upper link pivot pin 58, the joint pin 60, and the blade carrier pin 62. Note that it is not necessary to show the travel of the joint pin 60 for purposes of this discussion, and that the position of the joint pin 60 in the ON position, in an intermediate position, and in the TRIPPED position (points B1, B2, and B3 respectively) are shown only for completeness purposes. In the ON position, the blade carrier pin 62 is located at point A1 and the upper link pivot pin 58 is located at point C1. At an intermediate position, between the ON position and the TRIPPED position, the blade carrier pin 62 is located at point A2 and the upper link pivot pin 58 is located at point C2. The path traveled between point A1 and point A2 is relatively equal to the path traveled between point C1 and point C2. After the initial sliding movement of the link angled surface 76 along the guide angled surface 88, the speed becomes relatively constant. Then, after the radiused protrusion 72 makes contact with the ramp surface 86, the shift in the pivoting point occurs. In the TRIPPED position, the blade carrier pin 62 is located at point A3 and the upper link pivot pin 58 is located at point C3. The distance traveled by the blade carrier pin 62, and consequently by the blade carrier assembly 40, between point A2 and A3 is much larger than the distance traveled by the upper link pivot pin 58 between point C2 and C3. Because the motion of the upper link pivot pin 58 remains at the same speed, this means that the motion of the blade carrier pin 62 must be much faster, i.e., it must be accelerated.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A switching mechanism for use in an electro-mechanical device, the mechanism comprising:

a trip lever;

a blade carrier assembly;

a frame guide having a guiding area;

a lower link having a first end and a second end for moving the blade carrier assembly between an ON and a TRIPPED position of the electro-mechanical device, the first end being connected to the blade carrier assembly; and an upper link having a lower link end, a trip lever end, and an interface area, the lower link end being connected to the second end of the lower link, the trip lever end being connected to the trip lever, at least a portion of the interface area being adapted to remain in continuous contact with the guiding area in the ON position, in the TRIPPED position, and while moving between the ON position and the TRIPPED position.

2. The switching mechanism of claim 1, wherein the electro-mechanical device is a circuit breaker.

3. The switching mechanism of claim 1, wherein the frame guide includes a resting surface adapted to stop the motion of the upper link.

4. The switching mechanism of claim 1, wherein the frame guide further comprises:

a resting surface adapted to stop the motion of the upper link; and a slidably-engaging area located near the resting surface adapted to accelerate the motion of the upper link when the interface area is proximate the resting surface.

5. The switching mechanism of claim 1, wherein the guiding area includes an angled surface adapted for stopping the blade in the ON position and for engaging the interface area during the transition from the ON position to the TRIPPED position.

6. The switching mechanism of claim 1, wherein the interface area has a slidably-engaging area adapted for stopping the blade in the ON position and for engaging the interface area during the transition from the ON position to the TRIPPED position.

7. The switching mechanism of claim 1, wherein the interface area of the upper link has a radiused protrusion located near the trip lever end, the protrusion being adapted to cause an accelerated motion of the blade carrier assembly between the ON position and the TRIPPED position.

8. The switching mechanism of claim 1, the upper link further comprising:

a radiused protrusion located near the trip lever end, the protrusion being adapted to cause an accelerated motion of the blade carrier assembly between the ON position and the TRIPPED position; and a front surface located near the radiused protrusion being adapted to stop in the resting surface when the switching mechanism is in the TRIPPED position.

9. The switching mechanism of claim 1, the frame guide further comprising a resting surface located near an end of the guiding area, the upper link further comprising a front surface located near the trip lever end, the front surface being adapted to stop in the resting surface when the switching mechanism is in the TRIPPED position.

10. The switching mechanism of claim 1, the upper link further comprising a clearance surface located on the interface area, between a first slidably-engaging surface and a second slidably-engaging surface.

11. The switching mechanism of claim 1, the upper link further comprising a curved clearance surface located on the interface area, between an angled surface and a radiused protrusion.

12. A switching mechanism for use in an electro-mechanical device, the mechanism comprising:

a trip lever;

a blade carrier assembly;

a frame guide having a guiding area, the guiding area having at least two separate guiding surfaces;

a lower link having a first end and a second end for moving the blade carrier assembly between an ON and a TRIPPED position of the electro-mechanical device, the first end being connected to the blade carrier assembly; and an upper link having a lower link end, a trip lever end, and an interface area, the lower link end being connected to the second end of the lower link, the trip lever end being connected to the trip lever, the interface area being adapted to remain in continuous contact with the guiding area in the ON position, in the TRIPPED position, and while moving between the ON position and the TRIPPED position.

13. The switching mechanism of claim 12, wherein the frame guide further comprises:

a resting surface adapted to stop the motion of the upper link; and a slidably-engaging area located near the resting surface adapted to accelerate the motion of the upper link when the interface area is proximate the resting surface.

14. The switching mechanism of claim 13, the upper link further comprising:

a radiused protrusion located near the trip lever end, the protrusion being adapted to cause an accelerated motion of the blade carrier assembly between the ON position and the TRIPPED position; and a front surface located near the radiused protrusion being adapted to stop in the resting surface when the switching mechanism is in the TRIPPED position.

15. The switching mechanism of claim 12, wherein one of the at least two separate guiding surfaces is an angled surface adapted for stopping the blade in the ON position and for engaging the interface area during the transition from the ON position to the TRIPPED position.

16. A switching mechanism for use in an electro-mechanical device, the mechanism comprising:

a trip lever;

a blade carrier assembly;

a frame guide having a guiding area;

a lower link having a first end and a second end for moving the blade carrier assembly between an ON and a TRIPPED position of the electro-mechanical device, the first end being connected to the blade carrier assembly; and an upper link having a lower link end, a trip lever end, and an interface area, the lower link end being connected to the second end of the lower link, the trip lever end being connected to the trip lever, the interface area having two separate slidably-engaging areas at least a portion of at least one of said slidably-engaging areas being adapted to remain in continuous contact with the guiding area in the ON position, in the TRIPPED position, and while moving between the ON position and the TRIPPED position.

17. The switching mechanism of claim 16, wherein one of the two separate slidably-engaging areas is adapted for stopping the blade in the ON position and for engaging the interface area during the transition from the ON position to the TRIPPED position.

18. The switching mechanism of claim 16, wherein the interface area of the upper link has a radiused protrusion located near the trip lever end, the protrusion being adapted to cause an accelerated motion of the blade carrier assembly between the ON position and the TRIPPED position.

19. The switching mechanism of claim 16, the frame guide further comprising a resting surface located near an end of the guiding area, the upper link further comprising a front surface located near the trip lever end, the front surface being adapted to stop in the resting surface when the switching mechanism is in the TRIPPED position.

20. The switching mechanism of claim 16, the upper link further comprising a clearance surface located on the interface area, between the two separate slidably-engaging areas.

21. The switching mechanism of claim 16, the upper link further comprising a curved clearance surface located on the interface area, between an angled surface and a radiused protrusion.

* * * * *